United States Patent [19]

Niwa et al.

[11] Patent Number: 4,657,557

[45] Date of Patent: Apr. 14, 1987

[54] SHEETS FOR SUBLIMATION TRANSFER RECORDING

[75] Inventors: Toshio Niwa, Yokohama; Yukichi Murata, Sagamihara; Takashi Morishima, Machida, all of Japan

[73] Assignee: Mitsubishi Chemical Industries Limited, Tokyo, Japan

[21] Appl. No.: 720,758

[22] Filed: Apr. 8, 1985

[30] Foreign Application Priority Data

Apr. 23, 1984 [JP] Japan ..... 59-81617

[51] Int. Cl.[4] ..... B41M 5/26

[52] U.S. Cl. ..... 8/471; 428/195; 428/488.4; 428/532; 428/913; 428/914

[58] Field of Search ..... 8/470, 471; 428/195, 428/535, 536, 913, 914, 488.4, 532

[56] References Cited

U.S. PATENT DOCUMENTS

| | | | |
|---|---|---|---|
| 3,952,131 | 4/1976 | Sideman | 428/914 |
| 4,059,471 | 11/1977 | Haigh | 428/914 |
| 4,253,838 | 3/1981 | Mizuno et al. | 428/914 |

*Primary Examiner*—Bruce H. Hess

*Attorney, Agent, or Firm*—Bierman & Muserlian

[57] ABSTRACT

A sheet for sublimation transfer recording which is characterized by being composed of a base coated with an ink for sublimation heat-sensitive transfer and further coated with a heat-resistant resin such as a water-soluble cellulose type derivative, e.g., methyl cellulose, hydroxyethyl cellulose, hydroxypropyl cellulose, hydroxypropylmethyl cellulose or hydroxybutylmethyl cellulose. The obtained recording has good definition and shows no abrasion staining in the non-printed part of the image receiving body, and peeling-off of the recording sheet from the image receiving body is easy.

4 Claims, No Drawings

SHEETS FOR SUBLIMATION TRANSFER RECORDING

BACKGROUND OF THE INVENTION 1. Field of the Invention

This invention relates to sheets for sublimation transfer recording.

In office automation terminals such as facsimiles, printers, copying machines etc. which have lately been rapidly spread, there has been an increasing demand for color recording having a capacity for a great amount of information and also being visually preferable. On the other hand, the development of techniques of color recording of television images has been sought.

Currently, for these purposes, color recording techniques by electron photography, an ink-jet process, a heat-sensitive transfer recording process etc. have been under study. Of those, the heat-sensitive transfer recording process is considered a more advantageous process as compared with other processes since the maintenance and operation of the device are easier and the device and enpendable supplies are less expensive.

The heat-sensitive transfer recording process is a process which comprises overlapping a sheet-formed base coated with an ink containing a dye with an image receiving body with its ink-coated surface inside and thereafter heating the back surface of the ink-coated surface of the base by a heat-sensitive head to transfer the dye on the base to the image receiving body.

The heat-sensitive transfer recording process is roughly classified into two modes, i.e., a molten transfer process which comprises using a recording sheet composed of a base coated with a heat-melt ink and a sublimation transfer process which comprises using a recording sheet coated with an ink containing a sublimable dye, and the latter is more advantageous in particular for full color recording since it is possible to control the amount of the dye to be sublimed and transferred by controlling the energy applied to a heat-sensitive head and hence gradation expression is easy.

2. Description of the Prior Art

In general, since the temperature of the heat-sensitive head on transfer recording reaches 200° C. or higher, where a conventional recording sheet was used, there were such problems that a binder resin on the recording sheet softened or melted by heat, and the recording sheet and an image receiving body were adhered to each other and hence release after recording was difficult, that the binder resin was transferred to the image receiving body together with the dye and thus gradation expression was impossible, etc.

Further, on transfer recording, since the recording sheet and the image receiving body were overlapped and forwarded together, there was, for example, such problem that by abrasion of the contacted surfaces of both, a phenomenon of abrasion staining was brought about, that is, the non-printed part of the receiving body was stained, and so forth.

Therefore, as a method of preventing adhesion of the recording sheet and the image receiving body, there have been proposed methods of improving heat resistance by employing crosslinkable resins as a binder resin for the recording sheet and a resin for the image receiving body (Japanese patent application Laid-open No. 215397/1983, Japanese patent aplication Laid-open No. 212994/1983 and Japanese patent application Laid-open No. 215398/1983).

SUMMARY OF THE INVENTION

Accordingly, it is an object of this invention to provide a sheet for sublimation heat-sensitive transfer recording which has good release properties from an image receiving body after transfer recording and does not cause abrasion staining on the non-printed part of the image receiving body by coating an ink for sublimation heat-sensitive transfer on a base and further coating thereon a specific heat-resistant resin.

In other words, this invention resides in a sheet for sublimation transfer recording which is characterized by being composed of a base coated with an ink for sublimation heat-sensitive transfer and further coated with a heat-resistant resin.

DETAILED DESCRIPTION OF THE PREFERRED EMBODIMENTS

The sheet for sublimation heat-sensitive transfer recording of this invention (hereinafter referred to as the recording sheet) may be obtained by coating an ink for sublimation heat-sensitive transfer (hereinafter referred to as the ink) on a base and, after drying, coating a heat-resistant resin thereon as an aqueous solution or dispersion.

As the aforesaid base, tissue paper such as condenser paper, glassin paper etc. and plastic films having good heat resistance, such as a polyester type, a polyamide type, a polyimide type etc. may be used, and the thickness of the base is suitably in the range of 3–25 μm.

Further, as needed, it is also possible to provide heat-resistant treatment by providing a heat-resistant protecting film of a silicone resin, an epoxy resin, a melamine resin, a phenolic resin, a fluorine resin, a polyimide resin etc. on the back surface of the ink-coated surface of said base, in order to prevent sticking to the heat-sensitive head.

The aforesaid ink may be obtained by using a solvent or water as a medium, adding a nonionic sublimable dye and a dispersant thereto, finely dispersing using a dispersing machine such as a sand grind mill, a ball mill etc., and mixing with a binder resin used in conventional printing inks, etc.

As the aforesaid nonionic sublimable dye, nonionic dyes used in transfer printing of polyester fibers may be used, and in chemical structure, they are such dyes as azo types, anthraquinone types, nitro types, styryl types, naphthoquinone types, quinophthalone types, azomethine types, coumaline types, condensed polyring types etc.

As the dispersant, anionic, cationic and nonionic dispersants used in disperse dyestuffs etc. may be employed.

As the binder resin, there may be used those used in conventional printing inks, for example, solvent-soluble resins such as rosin types, phenolic types, xylene types, poteroleum types, vinyl types, polyamide types, alkyd types, nitrocellulose types, alkyl cellulose types, polyester types, polysulfones, polycarbonates etc. and water-soluble resins such as maleic acid types, acrylic acid types, cellulose types, casein, shellac, glue etc.

In order to coat the aforesaid ink on the base, for example, it may be effected by using a reverse roll coater, a gravure coater, a rod coater, an air doctor coater etc. set forth in "Coating Method" (1977) by Yuuji Harazaki, published from Maki Shoten.

The thickness of the coat layer of the ink on the base is in the range of 0.01–5 μm, preferably in the range of 0.1–3 μm.

The heat-resistant resin to be further coated on the coat layer of the aforesaid ink is a resin having a melting point of at least 150° C., preferably 170° C. or higher so that it does not melt by the heat of the heat-sensitive head on transfer recording and specific examples thereof include cellulose derivatives such as methyl cellulose, hydroxyethyl cellulose, hydroxypropyl cellulose, hydroxypropylmethyl cellulose, hydroxybutylmethyl cellulose, carboxymethyl cellulose etc., water-soluble resins such as alginic acid, starch and its derivatives, polyvinyl alcohol, polyacrylic acid etc., and water-insoluble resins such as polycarbonates, polyesters, polyamides, polyimides, polyamide-imides, polysulfones, polyether sulfones, polyphenylene sulfides, polyphenylene oxides, polyacrylates etc., preferably cellulose derivatives, and particularly preferably methyl cellulose, hydroxyethyl cellulose, hydroxypropyl cellulose, hydroxypropylmethyl cellulose and hydroxybutylmethyl cellulose.

Further, the aforesaid heat-resistant resin is used as an aqueous solution or dispersion, that is, as an aqueous solution in the case of a water-soluble resin or as an aqueous dispersion in the case of a water-insoluble resin.

The aqueous solution or dispersion of the aforesaid heat-resistant resin is coated on the ink coat layer in a manner similar to the method of coating the aforesaid ink on the case.

The thickness of the coat layer of the heat-resistant resin is suitably in the range of about 0.01–2 μm, preferably in the range of 0.05–1 μm, since if it is too thin, the effect is small whereas if too thick, sublimation transfer of the dye on recording is interfered.

When heat-sensitive transfer recording was conducted using the recording sheet obtained by the above-described method, release from the image receiving body after transfer recording was good and no abrasion staining was generated on the non-printed part of the image receiving body. Further, gradation expression was good.

This invention is more particularly described by the following examples, but it should be noted that this invention be not restricted to these examples.

EXAMPLE 1

(a) Preparation of an Ink 10 g of C. I. Disperse Blue 14 and 2 g of a polyethylene glycol phenol ether type dispersant, NEWCOL 710F (trade name, produced by Nippon Emulsifier Co., Ltd.) were added to 40 ml of water and treated by a sand grind mill to finely disperse. This fine dispersion and 50 g of an aqueous acrylic resin A-110 (trade name, containing 40% of solids, produced by Toa Gosei Chemical Industry Co., Ltd.) were mixed to prepare an ink.

(b) Preparation of a Recording Sheet

A polyethylene terephthalate film (12 μm in thickness) in which the back surface of the ink-coated surface had been rendered heat resistant by coating a polyimide resin was prepared as a base, and a recording sheet was prepared by the following procedures.

That is, the aforesaid ink (a) was coated on the base (6 μm in wet thickness) using a bar coater, then, after drying, a 5% aqueous solution of hydroxyethyl cellulose was coted (6 μm in wet thickness) using a bar coater, and dried to obtain a recording sheet.

(c) Preparation of an Image Receiving Body

An aqueous dispersion of a polyester resin, VYLONAL MD1200 (trade name, containing 34% of solids, produced by Toyo Spinning Co., Ltd.) was coated on art paper having a basis weight of 104.7 g/m$^2$ (24 μm in wet thickness) using a bar coater and dried to prepare an image receiving body.

(d) Transfer Recording Test and Results

Using the aforesaid recording sheet and image receiving body, an electric voltage of 0.6 w/dot was applied for 2, 4, 6, 8 or 10 milliseconds using a heat-sensitive head having an exothermic resistance element density of 4 dots/mm to effect recording and, as a result, the recording sheet and the image receiving body did not adhere to each other during recording and after recording it was possible to easily peel-off the recording sheet from the image receiving body.

Further, there was observed no abrasion staining in the non-printed part of the image receiving body.

Each obtained recording showed good definition of each dot, exhibited a brilliant cyan color, and the color density showed such increase as 0.1, 0.2, 0.4, 0.6 and 0.9 with the increase of the aforesaid applying time, thus demonstrating that gradation expression may be effected satisfactorily.

The color density was measured using a densitometer Model RD-514 (Filter: latin No. 25) produced by Macbeth Co., U.S.A., and calculated according to the following formula:

$$\text{Color Density} = \log_{10} (I_o/I)$$

wherein $I_o$: strength of the reflected light from a standard white reflecting panel.

I: strength of a reflected light from a test object.

The color density in each of the following examples was determined by similar procedures.

COMPARATIVE EXAMPLE 1

Transfer recording was conducted in a manner similar to that in Example 1 except that the recording sheet was prepared without coating the heat-resistant resin hydroxyethyl cellulose as in (b) of Example 1. As a result, the recording sheet and the image receiving body adhered to each other in the case where the applying time was 6, 8 or 10milliseconds, and after recording, the peel-off of the recording sheet from the image receiving body was difficult.

Further, there was observed blue color abrasion staining in the non-printed part of the image receiving body.

EXAMPLE 2

(a) Preparation of an Ink 2 g of C. I. Disperse Blue 14, 8 g of ethyl cellulose and 90 g of isopropanol were conditioned in a paint conditioner for about 30 minutes to prepare an ink.

(b) Preparation of a Recording Sheet

A recording sheet was prepared using condenser paper (10 μm in thickness) as a base by the following procedures.

That is, the aforesaid ink (a) was coated on the base (6 μm in wet thickness) using a bar coater, then, after drying, a 1% aqueous solution of hydroxypropylmethyl cellulose METOLOSE 60 SH-4000 (trade name, produced by Shin-etsu Chemical Industry Co., Ltd.) was coated thereon (6 μm in wet thickness) and dried to prepare a recording sheet.

(c) Preparation of an Image Receiving Body

An image receiving body was prepared by the procedures described in c) of Example 1.

(d) Transfer Recording Test and Results

Using the aforesaid recording sheet and image receiving body, transfer recording was conducted in a manner similar to that described in (d) of Example 1. As a result, the recording sheet and the image receiving body did not adhere to each other during recording, and after recording, it was possible to easily peel-off the recording sheet form the image receiving body.

Further, there was observed no abrasion staining in the non-printed part of the image receiving body.

Each obtained recording showed good definition of each dot, exhibited a brilliant cyan color, and the color density showed an increase with the increase of the aforesaid applying time, thus demonstrating that gradation expression may be effected satisfactorily.

COMPARATIVE EXAMPLE 2

Transfer recording was conducted in a manner similar to that described in Example 2 except that the recording sheet was prepared without coating the heat-resistant resin hydroxypropylmethyl cellulose as in (b) of Example 2. As a result, the recording sheet and the image receiving body adhered to each other in the case where the applying time was 6, 8 or 10 milliseconds, and after recording, the peel-off of the recording sheet from the image receiving body was difficult.

Further, there was observed blue color abrasion staining in the non-printed part of the image receiving body.

EXAMPLES 3-7

In each example, a recording sheet was prepared and transfer recording was conducted in a manner similar to that described in Example 1 except that the hydroxyethyl cellulose aqueous solution used in Example 1 was replaced by the resin solution or dispersion set forth in Table 1 respectively. As a result, no adhesion occurred between the recording sheet and the image receiving body on recording, and after recording, it was possible to easily peel-off the recording sheet from the image receiving body. Further, there was observed no abrasion staining in the non-printed part of the image receiving body.

Each obtained recording showed good definition and gradation expression and exhibited a brilliant cyan color.

TABLE 1

| Example No. | Aqueous Solution or Dispersion of Heat-Resistant Resin |
|---|---|
| 3 | 1% Aqueous solution of hydroxypropylmethyl cellulose MARPOLOSE MP-4000*1 |
| 4 | 1% Aqueous solution of methyl cellulose MARPOLOSE EM-2000*2 |
| 5 | 5% Aqueous solution of hydroxypropyl cellulose HPC-M*3 |
| 6 | 5% Aqueous solution of carboxymethyl cellulose |
| 7 | 5% Aqueous dispersion of a linear saturated polyester type resin PLASCOAT*4 |

(Notes)
*1Trade name, produced by Matsumoto Yushi Seiyaku Co., Ltd.
*2Trade name, produced by Matsumoto Yushi Seiyaku Co., Ltd.
*3Trade name, produced by Nippon Soda Co., Ltd.
*4Trade name, produced by GOO CHEMIKAL Industries Co., Ltd.

What is claimed is:

1. A sheet for sublimation transfer recording composed of a base coated with an ink containing non-ionic sublimable dye for sublimation heat-sensitive transfer and further coated with a heat-resistant resin characterized by using water-soluble cellulose type derivative as the het-resistant resin.

2. The sheet for sublimation transfer recording according to claim 1 wherein the water-soluble cellulose type derivative is methyl cellulose, hydroxyethyl cellulose, hydroxypropyl cellulose, hydroxypropylmethyl cellulose or hydroxybutylmethyl cellulose.

3. The sheet for sublimation transfer recording according to claim 1 wherein the water-soluble cellulose type derivative is hydroxyethyl cellulose, hydroxypropyl cellulose, hydroxypropylmethyl cellulose or hydroxybutylmethyl cellulose.

4. The seet for sublimation transfer recording according to claim 1 wherein the water-soluble cellulose type derivative is hydroxyethyl cellulose, hydroxypropyl cellulose or hydroxypropylmethyl cellulose.

* * * * *